US006201374B1

(12) United States Patent
Ater et al.

(10) Patent No.: US 6,201,374 B1
(45) **Date of Patent: *Mar. 13, 2001**

(54) VOLTAGE REGULATION AND POWER SWITCHING SYSTEM

(75) Inventors: Dan Ater, Newton; Samuel Ben-Meir, Sharon, both of MA (US)

(73) Assignee: 3Com Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/078,460

(22) Filed: May 14, 1998

(51) Int. Cl.[7] ..... G05F 1/40
(52) U.S. Cl. ..... 323/267; 323/282; 327/541
(58) Field of Search ..... 232/267, 268, 232/351, 273, 282; 327/338, 340, 341, 343

(56) References Cited

U.S. PATENT DOCUMENTS 4,461,690 * 7/1984 Rolff et al. ..... 323/267
5,592,072 * 1/1997 Brown ..... 323/267
5,774,813 * 6/1998 Jokinen ..... 455/574

* cited by examiner

*Primary Examiner*—Peter S. Wong
*Assistant Examiner*—Rajni Kant D. Patel
(74) *Attorney, Agent, or Firm*—Howard Zaretsky; David J. Weitz; Wilson Sonsini Goodrich & Rosati

(57) ABSTRACT

A power switching and voltage regulation system utilizing a conventional switching element to provide distributed power switching and voltage regulation. The system utilizes a switching element to impose an impedance in a controlled manner to provide power to a load such as a plug-in module in an electronic apparatus. The power source supplying an input DC voltage is intentionally set to a higher voltage than the level required by the plug-in module. The voltage supplied is required to be sufficiently high such that the voltage delivered to the plug-in module, exceeds the maximum permitted voltage level of the voltage required by the particular plug-in module. Once the switching device is turned on, the switching element exerts an impedance which functions to drop the voltage supplied to the load to the required value. The impedance is generated in accordance with a feedback control signal. The drop in voltage is achieved in accordance with a reference signal input to a comparison circuit such as an operational amplifier. A first embodiment discloses a system wherein a plurality of DC output voltages are generated in which all the output voltage levels are the same. A second embodiment discloses a system wherein a plurality of DC output voltages are generated whereby the level of each output voltage is independent of the others.

33 Claims, 4 Drawing Sheets

VOLTAGE REGULATION AND POWER SWITCHING SYSTEM

FIELD OF THE INVENTION

The present invention relates generally to electrical power systems and more particularly relates to the integration of voltage regulation and power switching systems.

BACKGROUND OF THE INVENTION

The power requirements for electrical and electronic systems being designed today are placing increasing demands upon power supply designs. The latest semiconductor devices call for lower and lower supply voltage levels. The typical 5 V supply has been reduced to 3.3 V for many components. Many semiconductor devices already available require an even lower supply voltage of 2.8 V such as memory devices.

A high level block diagram illustrating an example of a prior art power supply distribution system in an electronic device is shown in FIG. 1. The power supply distribution system, generally referenced 200, comprises a power supply 202, power supply wires or cables 204, sense wires 206 for voltage feedback, distribution bus 208 and a plurality of printed circuit cards (PCBs) 210, 212.

The power supply 202 receives an input voltage from a source of electrical power and functions to generate an output voltage which is distributed to the power distribution bus 208 via cables 204. Cables 206 comprise sense wires to provide voltage feedback to the power supply 202. The power supply 202 utilizes the feedback voltage in maintaining a stable output voltage.

Typical systems comprise a plurality of PC boards that connect to a backplane via a modular connector. For example printed circuit board 210 connects to the power distribution bus, i.e., the typically the backplane, via connector 220. Similarly, printed circuit board 212 connects to the power distribution bus via connector 222.

On some printed circuit boards, also termed plug-in boards or modules, electrical power is delivered directly to the board once the board 210 is seated in the connector 220. The electrical load placed on the power supply 202 is represented by the load block 211 on printed circuit board 210.

On other printed circuit boards electrical power is switched on the board itself. Printed circuit board 212 is an example of such a type of board. After the board 212 is seated in the connector 222, electrical power flows to the load 213 only when switches 215 are closed. In this case, electrical power to the plug-in modules like module 213 is controlled by switching devices such as switches 215 on board 212. Typically, the unit housing the distribution system 200 comprises a central control unit (not shown) which functions to control electrical power to the modules. Once a new module is installed in the system, for example, a request is made to the central control unit to activate the new module. Upon receiving the request, the central control unit examines the functional parameters of the particular module and if the parameters are within predetermined tolerances, the central control unit switches on electrical power to the new plug-in module.

The switching device 215 may comprise any suitable switch such as an electromechanical relay, solid sate relay, transistor or other controllable switching device.

The prior art electrical power distribution scheme described above, however, fails to deliver electrical power with sufficient accuracy when the required voltage levels begins to drop, for example, to 3.3 V and less. This is a major disadvantage especially considering that, the current trend in electronic technology is to operate electronic components at lower and lower voltages, e.g., 3.3 V +/−5%, 2.8 V +/−5% or lower. At such low voltage values, the current needed to be supplied is fairly large while the permitted variability of the voltage supply is only a few tens of millivolts. Even a small modest impedance naturally existent in the copper traces and connectors making up the power distribution path will cause voltage drops much larger than tens of millivolts. To make matters worse, the impedance in the copper traces and the connectors is usually not a design parameter that can be adjusted arbitrarily. In actuality, the impedance in the copper trances and the connectors is typically unpredictable.

The following example illustrates the problems associated with the prior art power distribution system. Consider a plug-in module that consumes 100 W which at 3.3 V draws approximately 30 A. An impedance of 10 mΩ would generate a drop of approximately 300 mV. This voltage drop is already almost twice as large as the 5% tolerance of 165 mV. In another example, if one considers a power FET, the typical $R_{DS}$(On) impedance is approximately 4 mΩ. A current of 40 A yields a voltage drop of 160 mV which almost equals the 3.3 V 5% tolerance. Further, higher impedances, lower supply voltages and tighter tolerances only worsen the problem.

SUMMARY OF THE INVENTION

The present invention in a power switching and voltage regulation system that utilizes the conventional switching element is a new way. In prior art approaches, the switching element is configured to present a minimal impedance with zero impedance being ideal. The system of the present invention, in contrast, utilizes the switching element to impose an impedance in a controlled manner. The power source supplying an input DC voltage is intentionally set to a higher voltage than the level required by the plug-in module. The voltage supplied is required to be sufficiently high such that the voltage delivered to the plug-in module, i.e., the load, exceeds the maximum permitted voltage level of the voltage required by the particular plug-in module.

Once the switching device is turned on, the switching element exerts an impedance which functions to drop the voltage supplied to the load to the required value. The impedance is generated in accordance with a feedback control signal. The drop in voltage is achieved in accordance with a reference signal input to a comparison circuit such as an operational amplifier.

Two embodiments of the present invention are presented. The first embodiment discloses a system wherein a plurality of DC output voltages are generated in which all the output voltage levels are the same. The second embodiment also discloses a system wherein a plurality of DC output voltages are generated however the level of each output voltage is independent of the others.

There is therefore provided in accordance with the present invention a power switching and voltage regulation system for providing regulated electrical power to at least one plug-in module, the system comprising a voltage regulator coupled to a source of electrical power, the voltage regulator for generating an intermediate supply voltage, an on/off control unit for receiving an on/off command from an external source, a reference voltage generator for generating a reference voltage, the reference voltage regulator responsive to an output signal produced by the on/off control unit and regulation means for providing a controlled impedance which functions to regulate the intermediate supply voltage so as to provide an output voltage at a predetermined level to the plug-in module.

The system further comprises a fuse in series with the intermediate supply voltage output from the voltage regulator. In addition, the regulation means comprises an off state wherein electrical power to the plug-in module is turned off and an on state wherein a controlled impedance is placed in series with the intermediate supply voltage so as to generate the output voltage to the plug-in module.

Further, the regulation means comprises on/off control means for either turning electrical power to the plug-in module off or for enabling a controlled impedance and a controlled impedance placed in series with the intermediate supply voltage, the controlled impedance responsive to the on/off control means so as to maintain the output voltage at a predetermined level.

The controlled impedance may comprise a switching device, a semiconductor transistor or a semiconductor field effect transistor (FET). The regulation means comprises operational amplifier (op amp) means adapted to receive the reference voltage and a sample of the output voltage and a switching device responsive to the output of the op amp means, the switching device configured to function as a controlled impedance for generating the output voltage at a predetermined level from the intermediate voltage.

There is also provided in accordance with the present invention a power switching and voltage regulation system for providing regulated electrical power to a plurality of plug-in modules, the system comprising a voltage regulator coupled to a source of electrical power, the voltage regulator for generating an intermediate supply voltage, an on/off control unit for receiving an on/off command from an external source, a reference voltage generator for generating a reference voltage, the reference voltage regulator responsive to an output signal produced by the on/off control unit and a plurality of regulation means, each regulation means for providing a controlled impedance which functions to regulate the intermediate supply voltage so as to provide an output voltage at a predetermined level to the plug-in module, each regulation means generating the same level of output voltage.

Each regulation means comprises an on state wherein a controlled impedance is placed in series with the intermediate supply voltage so as to generate the output voltage to the plug-in module corresponding thereto.

Further, each regulation means comprises on/off control means for either turning electrical power to the plug-in module off corresponding thereto or for enabling a controlled impedance and a controlled impedance placed in series with the intermediate supply voltage, the controlled impedance responsive to the on/off control means so as to maintain the output voltage at a predetermined level.

Each regulation means comprises operational amplifier (op amp) means adapted to receive the reference voltage and a sample of the output voltage and a switching device responsive to the output of the op amp means, the switching device configured to function as a controlled impedance for generating the output voltage at a predetermined level from the intermediate voltage.

There is further provided in accordance with the present invention a power switching and voltage regulation system for providing regulated electrical power to a plurality of plug-in modules wherein the voltage level generated for one plug-in module is independent from that generated for other plug-in modules, the system comprising a plurality of voltage regulators, each voltage coupled to a source of electrical power, each voltage regulator for generating an intermediate supply voltage wherein the intermediate supply voltage generated for one plug-in module is independent of that generated for other plug-in modules, a plurality of on/off control units, each on/off control unit for receiving an on/off command from an external source, a plurality of reference voltage generators, each reference voltage generator for generating a reference voltage, each reference voltage regulator responsive to an output signal produced by its respective on/off control unit, wherein the reference voltage generated by one reference voltage generate is independent of reference voltages generated by other reference voltage generators and a plurality of regulation means, each regulation means for providing a controlled impedance which functions to regulate the intermediate supply voltage corresponding thereto so as to provide an output voltage at a predetermined level to its associated plug-in module.

BRIEF DESCRIPTION OF THE DRAWINGS

The invention is herein described, by way of example only, with reference to the accompanying drawings, wherein.

DETAILED DESCRIPTION OF THE INVENTION

Figure 1:
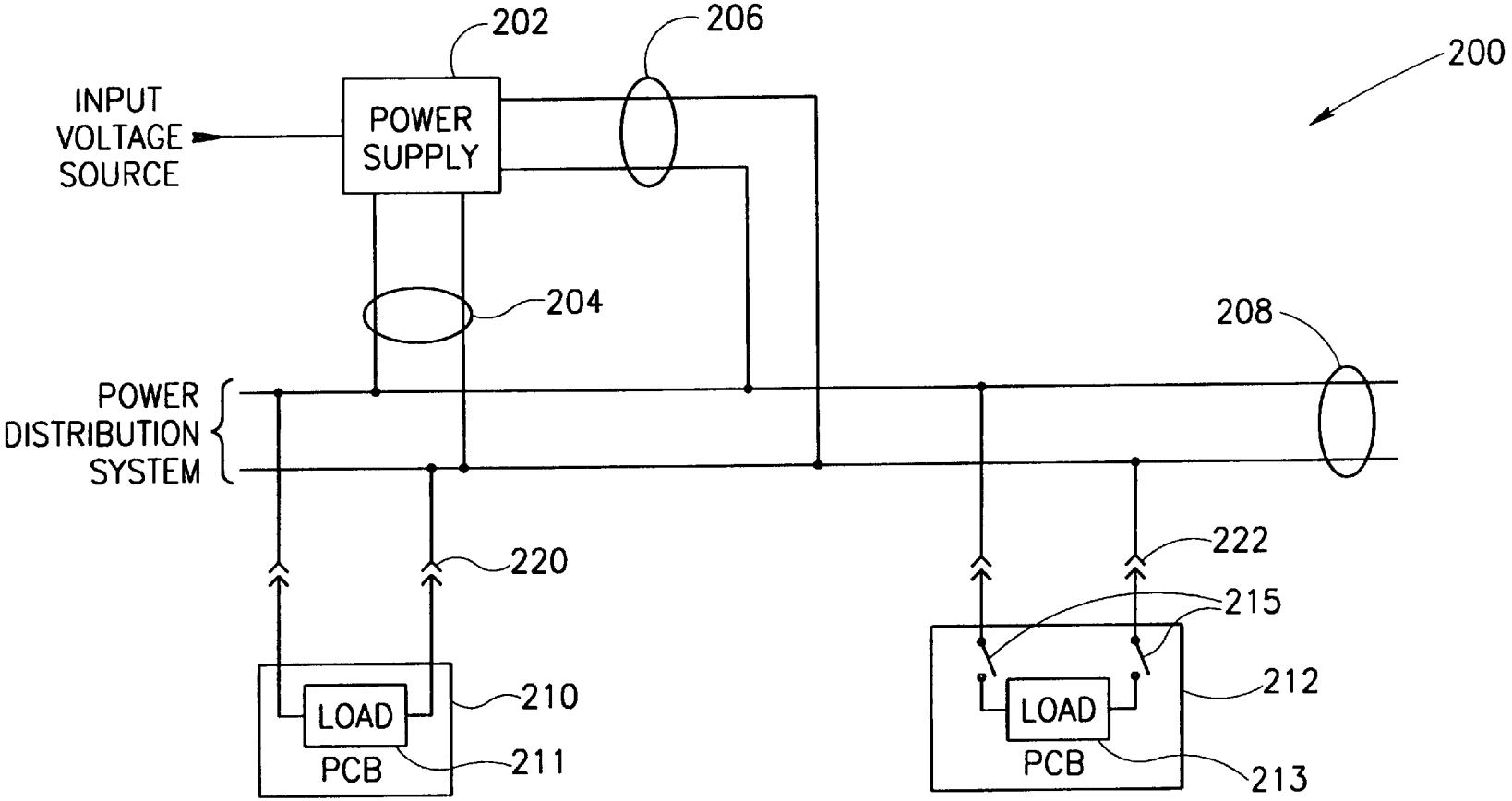
FIG. 1 PRIOR ART
FIG. 1 is a high level block diagram illustrating an example of a prior art power supply distribution system in an electronic device.
Figure 2:
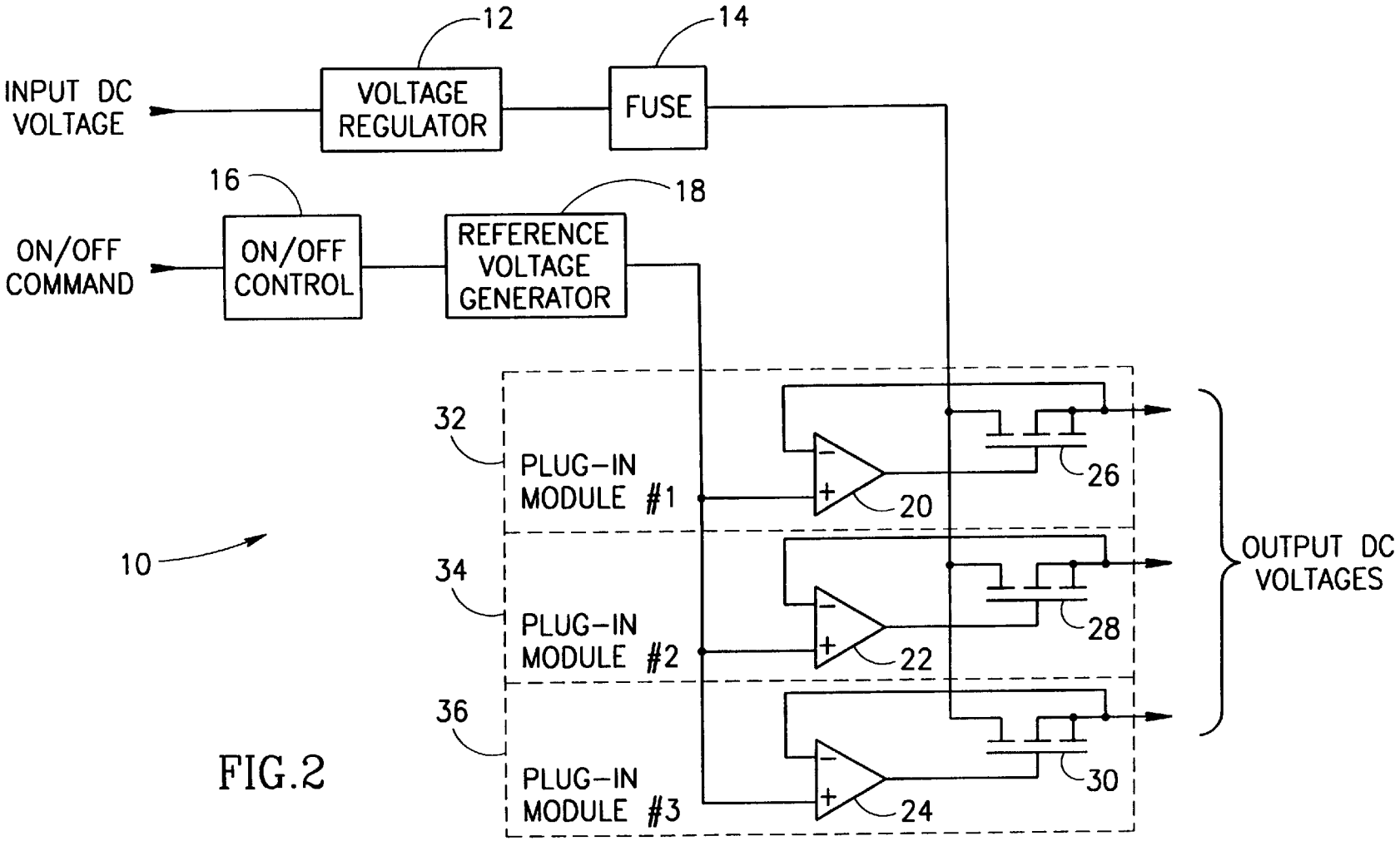
FIG. 2 is a high level block diagram illustrating a power supply distribution and regulation system constructed in accordance with a first embodiment of the present invention.

The present invention provides a system for integrating voltage regulation and power switching control functions. A high level block diagram illustrating a power supply distribution and regulation system constructed in accordance with a first embodiment of the present invention is shown in FIG. 2. The power supply system, generally referenced 10, comprises a voltage regulator 12, fuse 14, on/off control 16 and reference voltage generator 18. The power supply system also comprises operational amplifiers (op amps) 20, 22, 24 and transistors 26, 28, 30.

The principle of the present invention is to shift the location of the final regulation of the voltage used by the plug-in modules to the plug-in modules themselves. Rather than have a centralized power supply generate precise voltages which are then distributed to the various plug-in modules with consequent IR drops along the way, as described in the Background of the Invention section of this document, the present invention develops a precise output voltage directly on the plug-in module itself. This avoids the disadvantages of the prior art, i.e., the intolerable IR drops due to the copper traces and connectors.

An input DC voltage, either regulated or unregulated is input to the voltage regulator 12. The output voltage of the voltage regulator is set to a level slightly larger than that required by the plug-in modules. The voltage regulator thus outputs an intermediate voltage level. The output of the voltage regulator passes through a current protection fuse 14 before being routed to the plug-in modules 32, 34, 36. Note that although only three plug-in modules are represented in FIG. 2, one skilled in the electrical arts could easily adapt the present invention to any number of plug-in modules having various configurations.

Each plug-in module comprises voltage regulation and power switching circuitry adapted to receive two inputs. The first input is a reference voltage signal and the second is the regulated output voltage from the voltage regulator 12. The reference voltage is generated by the reference voltage generator 18. An on/off control unit 16 controls the operation of the reference voltage generator 18 via an output signal generated therefrom. An on/off command is applied to the on/off control unit 16 which functions to turn the voltage off to each of the plug-in modules.

In operation, the voltage regulator 12 supplies voltage to transistors 26, 28, 30 in plug-in modules 32, 34, 36, respectively. Optionally, the output of the voltage regulator can be routed through a switch (not shown) to further control power to the plug-in modules. An 'on' command input to the on/off control unit 16, causes the reference voltage generator 18 to be enabled. Conversely, an 'off' command to the on/off control unit 16 disables the reference voltage generator 18. The reference voltage is distributed to each of the plug-in modules that are to be supplied with the level of voltage associated with that particular reference voltage. The reference voltage is input to the non-inverting input of an op amp while the inverting input of each op amp is the sampled output voltage generated by the transistor for use by the components on the plug-in module. In particular, the voltage output of transistor 26 is fed back to the inverting input of op amp 20. Similarly, the voltage output of transistor 28 is fed back to the inverting input of op amp 22. Likewise, the voltage output of transistor 30 is fed back to the inverting input of op amp 24.

The output of each op amp is used to control each respective switching device. In the case of the switch comprising a MOSFET transistor, the output of each op amp is input to the gate of each transistor. In particular, the output of op amp 20 is input to the gate of transistor 26, the output of op amp 22 is input to the gate of transistor 28, the output of op amp 24 is input to the gate of transistor 30. The output of the transistor which is fed back to the inverting input of each op amp also constitutes the DC output voltage supplied to the plug-in module. Thus, the combination of an op amp and switching element, i.e., transistor, form a regulation circuit to provide a controlled impedance to the input DC voltage. Note that the switching element is able to be placed in an off state whereby electrical power to the plug-in module is turned off. When the switching element is placed in the on state, the controlled impedance is applied.

The switching devices 26, 28, 30 may comprise any suitable switch such as an electromechanical relay, solid sate relay, transistor or other controllable switching device. Suitable transistors include, but are not limited to FETs, JFETs and IGBTs.

An important principle of the present invention is that the function of the switching element is changed from that of the prior art. In the prior art approach, the switching element is required to present a minimal impedance, with the ideal impedance being zero. In the present invention, in contrast, the switching element intentionally imposes an impedance in a controlled manner. The input DC voltage in combination with the voltage regulator 12 is adapted to intentionally supply a voltage higher than that required by the plug-in module. The voltage supplied is required to be sufficiently high such that the voltage delivered to the plug-in module, i.e., to the switching devices 26, 28, 30, exceeds the maximum permitted voltage level of the voltage required by the plug-in module.

After the switching device is turned on via the on/off control unit 16 in combination with the reference voltage generator 18, each switching device exerts an impedance, in accordance with the feedback control via its associated op amp, which functions to drop the voltage supplied to the plug-in module to the required value. The drop in voltage is achieved in accordance with the reference signal input to the non-inverting input of each op amp.

Figure 3:
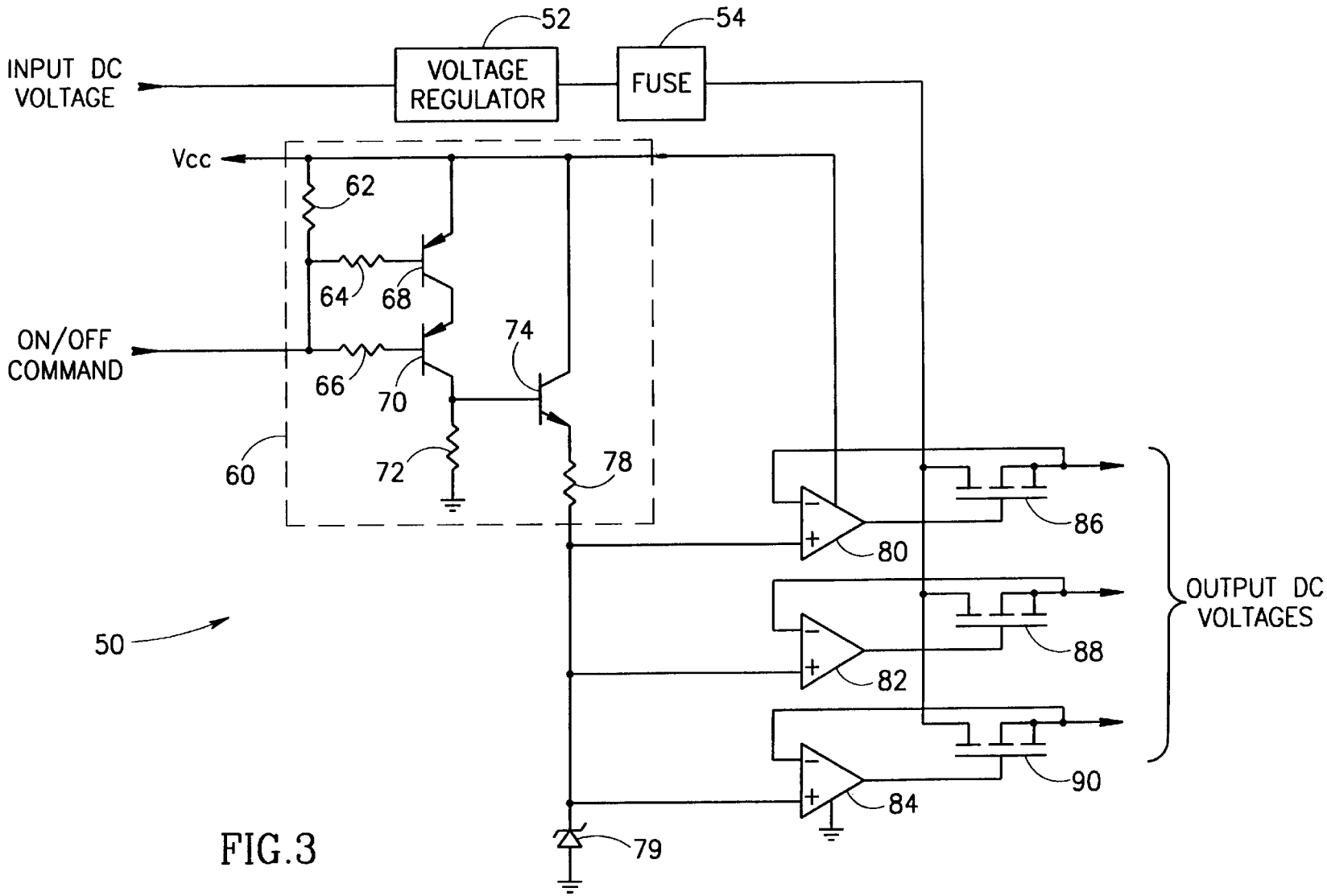
FIG. 3 is a schematic diagram illustrating the power supply distribution and regulation system constructed in accordance with the first embodiment in more detail.

A schematic diagram illustrating the power supply distribution and regulation system constructed in accordance with the first embodiment in more detail is shown in FIG. 3. Similar to that shown in FIG. 2, the power supply distribution and regulation system of FIG. 3, generally referenced 50, comprises a voltage regulator 52 which generates an output voltage from an input DC voltage. The voltage is input to a plurality of switching devices via current limiting fuse 54. Fuse 54 may also comprise a thermal cutoff device. The output of the fuse is input to one of the terminals of transistors 86, 88, 90 which function as switching devices. The on/off control and reference voltage regulation functions are performed by circuit block 60 which is adapted to receive an on/off command. Circuit block 60 comprises PNP transistors 68, 70, NPN transistor 74 and resistors 62, 64, 66, 72, 78.

The emitter of transistor 68 is connected to $V_{CC}$ and the base is connected to biasing resisters 62 and 64. The collector of transistor 68 is connected in totem pole fashion to the emitter of transistor 70. The collector of transistor 70 is connected to ground via resistor 72. The base of transistor 70 is connected to the on/off command via resistor 66.

The emitter of NPN transistor 74 is connected to the non-inverting input of each op amp via resistor 78. A zener diode 79 provides a stable reference voltage for each of the op amps. When the on/off command is high, transistors 68, 70 are off and there is insufficient drive to turn transistor 74 on. Consequently, switching devices, i.e., transistors 86, 88, 90, are all off, since op amps 80, 82, 84 cannot supply sufficient gate drive to turn the transistors on. The supply input of op amps 80, 82, 84 are all connected to $V_{CC}$.

When the on/off command is low, transistors 68, 70 are on and sufficient current flows through the base of transistor 74 to turn it on. Op amps 80, 82, 84 are supplied with sufficient voltage to operate and a reference voltage appears at the non-inverting input of op amps 80, 82, 84 so as to generate a stable DC output voltage from switches 86, 88, 90. As described in connection with system 10 of FIG. 2, the switching elements intentionally impose an impedance in a controlled manner. The circuit block 60 is adapted to intentionally supply a voltage higher than that required by the plug-in module. The voltage supplied is required to be sufficiently high such that the voltage delivered to the plug-in module, i.e., to the switching devices 86, 88, 90, exceeds the maximum permitted voltage level of the voltage required by the plug-in module.

After the switching device is turned on, each switching device exerts an impedance, in accordance with the feedback control via its associated op amp, which functions to drop the voltage supplied to the plug-in module to the required value. The drop in voltage is achieved in accordance with the reference signal input to the non-inverting input of each op amp.

Figure 4:
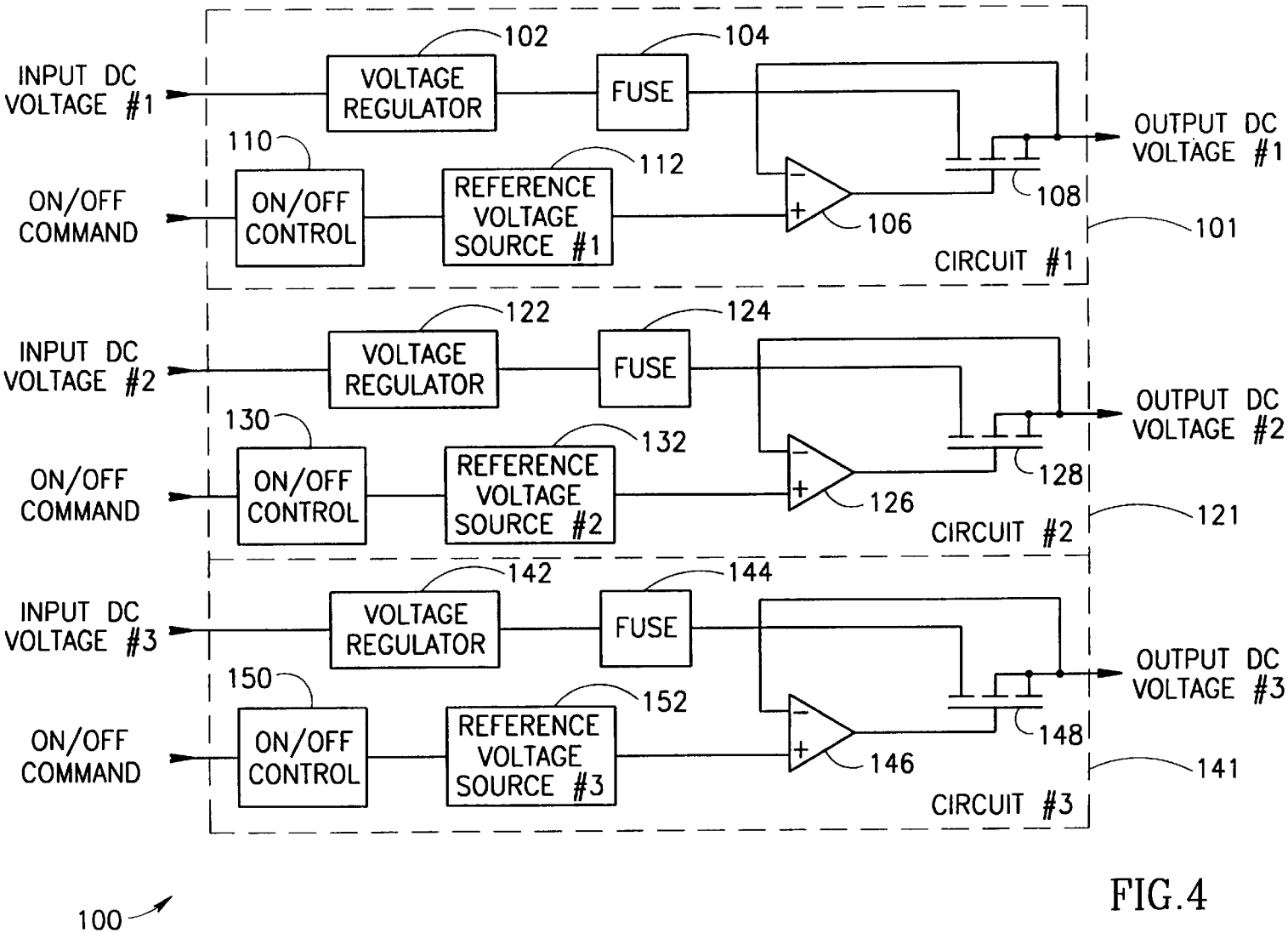
FIG. 4 is a block diagram illustrating a power supply distribution and regulation system constructed in accordance with a second embodiment of the present invention.

A block diagram illustrating a power supply distribution and regulation system constructed in accordance with a second embodiment of the present invention is shown in FIG. 4. The power supply distribution and regulation systems of FIGS. 2 and 3 can be adapted to supply a plurality of individual DC voltage levels rather than a plurality of the same DC voltage. For illustration purposes, only three independent circuits are shown. The present invention, however, can be utilized to provide an arbitrary number of independent output DC voltages, limited only by space and cost.

Circuit #1 101 comprises a voltage regulator 102 adapted to receive an input DC voltage #1, fuse 104, on/off control unit 110, reference voltage source #1 112, op amp 106 and switching device 108. Similarly, circuit #2 121 comprises a voltage regulator 122 adapted to receive an input DC voltage #2, fuse 124, on/off control unit 130, reference voltage source #2 132, op amp 126 and switching device 128. Likewise, circuit #3 141 comprises a voltage regulator 142 adapted to receive an input DC voltage #3, fuse 144, on/off control unit 150, reference voltage source #3 152, op amp 146 and switching device 148.

In the power supply distribution and regulation system, generally referenced 100, of FIG. 4 each op amp is supplied with its own reference voltage input to its non-inverting terminal. However, for each circuit, the voltage regulator functions to supply a voltage higher than that required by corresponding plug-in module. The voltage supplied is required to be sufficiently high such that the voltage delivered to the plug-in module, i.e., to the switching devices 108, 128, 148, exceeds the maximum permitted voltage level of the voltage required by the particular plug-in module.

After the switching device is turned on each switching device exerts an impedance, in accordance with the feedback control via its associated op amp, which functions to drop the voltage supplied to the plug-in module to the required value. The drop in voltage is achieved in accordance with the reference signal input to the non-inverting input of each op amp. Each reference voltage generated by each reference voltage source is independent of the other reference voltage sources.

Thus, the power switching and voltage regulation system of the present invention permits the input DC voltage to be generated in a central location with somewhat relaxed restrictions on the accuracy of the output voltage generated by the centralized power supply. This is because the final regulation of the voltage is performed directly on the plug-in module and thus the IR drops due to the copper traces and connectors have little effect on the output DC voltage supplied to the plug-in module.

In accordance with the present invention, it is preferable that the level of the voltage supplied to the switching device in each circuit be as close to the permitted maximum as possible so as to reduce the power dissipation. For example, a circuit configured to drop the input DC voltage by 250 mV which supplies 40 A to its plug-in module, must be able to dissipate 10 W of power. Thus, sufficient heat sinking and/or cooling must be provided in order to maintain reasonably normal operating temperatures.

Note that in both the first and second embodiment, even when an 'off' command is issued and the power to the plug-in modules is cut off, a small portion of the circuitry is still powered waiting for the issuance of an 'on' command. Upon receipt of an 'on' command, power is applied to the plug-in module circuitry.

While the invention has been described with respect to a limited number of embodiments, it will be appreciated that many variations, modifications and other applications of the invention may be made.

What is claimed is:

1. A voltage regulation system for providing a regulated output voltage, said system comprising:

a voltage regulator coupled to a source of electrical power, said voltage regulator for generating an intermediate supply voltage;

a reference voltage source;

a variable impedance having an impedance input, an impedance output, and an impedance control input, said impedance input electrically connected to said intermediate supply voltage, said variable impedance adapted to exert a series impedance so as to drop said intermediate supply voltage to a desired output voltage, said variable impedance adapted to provide at said impedance output the regulated output voltage, wherein the value of the impedance exerted is determined in accordance with an impedance control signal applied to said impedance control input;

an impedance control adapted to sense the difference between said output voltage and said reference voltage and to generate said impedance control signal in response thereto; and wherein the voltage level of said intermediate supply voltage is adapted to exceed said desired output voltage so as to compensate for a maximum expected voltage drop across said variable impedance.

2. The system according to claim 1, further comprising a fuse placed in series with the intermediate supply voltage output from said voltage regulator.

3. The system according to claim 1, further comprising an on/off control unit for receiving an on/off command from an external source and for generating an enable/disable signal therefrom, wherein said reference voltage regulator is adapted to be responsive to said enable/disable signal generated by said on/off control unit.

4. The system according to claim 3, wherein said on/off control unit comprises a disabled state wherein said regulated output voltage is turned off.

5. The system according to claim 3, wherein said on/off control unit comprises an enabled state wherein said variable impedance is placed in series with said intermediate supply voltage so as to generate said regulated output voltage.

6. The system according to claim 1, wherein said variable impedance comprises a semiconductor transistor.

7. The system according to claim 1, wherein said variable impedance comprises a semiconductor field effect transistor (FET).

8. The system according to claim 1, wherein said impedance control comprises an operational amplifier (op amp) having a first op amp input electrically connected to said reference voltage, second op amp input electrically connected to said impedance output and an op amp output, said op amp operative to sense the differential voltage between said reference voltage and the voltage at said impedance output and to generate said impedance control signal in response thereto, said impedance control signal indicative of the differential voltage sensed.

9. The system according to claim 1, wherein said variable impedance and said impedance control are co-located on a plug-in module separate from and without regard to the location of said voltage regulator.

10. A voltage regulation system for providing a plurality of output voltages, said system comprising:

a voltage regulator coupled to a source of electrical power, said voltage regulator for generating an intermediate supply voltage;

a reference voltage generator for generating a reference voltage;

a plurality of variable impedances, each said variable impedance having an impedance input, an impedance output, and an impedance control input, said impedance input electrically connected to said intermediate supply voltage, said variable impedance adapted to exert a series impedance so as to drop said intermediate supply voltage to a desired output voltage, said variable impedance adapted to provide at said impedance output the regulated output voltage, wherein the value of the impedance exerted is determined in accordance with an impedance control signal applied to said impedance control input;

a plurality of impedance controls, each said impedance control adapted to sense the difference between said output voltage and said reference voltage and to generate said impedance control signal in response thereto; and wherein the voltage level of said intermediate supply voltage is adapted to exceed said desired output voltage so as to compensate for a maximum expected voltage drop across each of said variable impedances.

11. The system according to claim 10, further comprising a fuse placed in series with the intermediate supply voltage output from said voltage regulator.

12. The system according to claim 10, further comprising an on/off control unit for receiving an on/off command from an external source and for generating an enable/disable signal therefrom, wherein said reference voltage regulator is adapted to be responsive to said enable/disable signal generated by said on/off control unit.

13. The system according to claim 12, wherein said on/off control unit comprises a disabled state wherein said regulated output voltage is turned off.

14. The system according to claim 12, wherein each said on/off control unit comprises an enabled state wherein said variable impedance is placed in series with said intermediate supply voltage so as to generate said regulated output voltage.

15. The system according to claim 10, wherein said variable impedance comprises a semiconductor transistor.

16. The system according to claim 10, wherein said variable impedance comprises a semiconductor field effect transistor (FET).

17. The system according to claim 11, wherein said impedance control comprises an operational amplifier (op amp) having a first op amp input electrically connected to said reference voltage, second op amp input electrically connected to said impedance output and an op amp output, said op amp operative to sense the differential voltage between said reference voltage and the voltage at said impedance output and to generate said impedance control signal in response thereto, said impedance control signal indicative of the differential voltage sensed.

18. The system according to claim 10, wherein said variable impedance and said impedance control are co-located on a plug-in module separate from and without regard to the location of said voltage regulator.

19. A voltage regulation system for providing a plurality of regulated output voltages, said system comprising:

a plurality of voltage regulators, each voltage regulator coupled to a source of electrical power and adapted to generate an intermediate supply voltage wherein the intermediate supply voltages are independent of one another;

a plurality of on/off control units, each on/off control unit for receiving an on/off command from an external source and for generating an enable/disable signal therefrom;

a plurality of reference voltage generators, each reference voltage generator for generating a reference voltage, each reference voltage regulator responsive to said enable/disable signal generated by said on/off control unit, wherein the reference voltages generated are independent of each other; and a plurality of variable impedances, each said variable impedance having an impedance input, an impedance output, and an impedance control input said impedance input electrically connected to one of said intermediate supply voltages, said variable impedance adapted to exert a series impedance so as to drop said intermediate supply voltage to a desired output voltage, said variable impedance adapted to provide at said impedance output one of said regulated output voltages, wherein the value of the impedance exerted is determined in accordance with an impedance control signal applied to said impedance control input;

a pluralitv of impedance controls, each said impedance control adapted to sense the difference between one of said output voltages and an associated reference voltage and to generate said corresponding impedance control signal in response thereto; and wherein the voltage level of each said intermediate supply voltage is adapted to exceed an associated desired output voltage so as to compensate for a maximum expected voltage drop across the corresponding variable impedance.

20. The system according to claim 19, further comprising a plurality of fuses in series with the intermediate supply voltage output from each of said plurality of voltage wherein a fuse is placed in series with the intermediate supply voltage output of each voltage regulator.

21. The system according to claim 19, further comprising a plurality of on/off control units, each on/off control unit for receiving an on/off command from an external source and for generating an enable/disable signal therefrom, wherein each said reference voltage regulator is adapted to be responsive to said enable/disable signal generated by said on/off control unit.

22. The system according to claim 21, wherein said on/off control unit comprises a disabled state wherein said regulated output voltage is turned off.

23. The system according to claim 21, wherein each said on/off control unit comprises an enabled state wherein said variable impedance is placed in series with said intermediate supply voltage so as to generate said regulated output voltage.

24. The system according to claim 19, wherein said variable impedance comprises a semiconductor transistor.

25. The system according to claim 19, wherein said variable impedance comprises a semiconductor field effect transistor (FET).

26. The system according to claim 19, wherein said impedance control comprises an operational amplifier (op amp) having a first op amp input electrically connected to said reference voltage, second op amp input electrically connected to said impedance output and an op amp output, said op amp operative to sense the differential voltage between said reference voltage and the voltage at said impedance output and to generate said impedance control signal in response thereto, said impedance control signal indicative of the differential voltage sensed.

27. The system according to claim 19, wherein said variable impedance and said impedance control are co-located on a plug-in module separate from and without regard to the location of said voltage regulator.

28. A method for providing a regulated output voltage from an input voltage, said method comprising the steps of:

providing a voltage regulator connected to an intermediate node;

inputting said input voltage to said voltage regulator so as to generate an intermediate supply voltage on said intermediate node thus performing a first regulation;

generating a reference voltage;

providing a variable impedance having a variable series impedance associated therewith, connecting said variable impedance between said intermediate node and an output node;

controlling said variable impedance so as to drop said intermediate supply voltage to a desired output voltage, thus performing a second regulation;

determining the value of the series impedance exerted in accordance with an impedance control signal applied to said variable impedance;

sensing the difference between said output voltage and said reference voltage and generating the impedance control signal in response thereto; and controlling the generation of the intermediate supply voltage such that it sufficiently exceeds the desired output voltage to compensate for a maximum expected voltage drop across said variable impedance.

29. The method according to claim 28, further comprising the step of providing an on/off control unit for receiving an on/off command from an external source and generating an enable/disable signal therefrom, said reference signal generated in accordance with said enable/disable signal.

30. The method according to claim 29, wherein said on/off control unit enters a disabled state whereby said regulated output voltage is turned off.

31. The method according to claim 29, wherein said on/off control unit enters an enabled state whereby said regulated output voltage is generated in accordance with said variable impedance.

32. The method according to claim 28, further comprising the step of co-locating said variable impedance on a plug-in module separate from and without regard to the location of said voltage regulator.

33. The method according to claim 28, wherein the intermediate voltage generated by said first regulation is sufficiently high enough to compensate for IR drops along the distribution path from the location of said first regulation to the location of said second regulation.

* * * * *